United States Patent [19]

Barbier et al.

[11] Patent Number: 4,696,157

[45] Date of Patent: Sep. 29, 1987

[54] FUEL AND AIR INJECTION SYSTEM FOR A TURBOJET ENGINE

[75] Inventors: Gerard Y. G. Barbier, Morangis; Gerald J. P. B. Lebouré, Avon; Michel A. A. Desaulty, Vert St Denis; Rodolphe Martinez, Perigny/Yerres; Jérome Perigne, Vaux le Penil, all of France

[73] Assignee: Societe Nationale D'Etude et de Construction de Moteurs D'Aviation "S.N.E.C.M.A.", Paris, France

[21] Appl. No.: 919,126

[22] Filed: Oct. 15, 1986

[30] Foreign Application Priority Data

Oct. 18, 1985 [FR] France ..... 85 15925

[51] Int. Cl.[4] ..... F02C 3/14

[52] U.S. Cl. ..... 60/39.23; 60/39.36; 60/748

[58] Field of Search ..... 60/39.23, 39.36, 39.37, 60/748, 751, 755, 756, 757, 752

[56] References Cited

U.S. PATENT DOCUMENTS

| | | | |
|---|---|---|---|
| 2,655,787 | 10/1953 | Brown | 60/39.23 |
| 3,490,230 | 1/1970 | Pillsbury et al. | 60/39.23 |
| 3,831,854 | 8/1974 | Sato et al. | 60/248 |
| 3,834,159 | 9/1974 | Vdoviak | 60/748 |
| 3,901,446 | 8/1975 | Petreikis et al. | 60/248 |
| 3,982,392 | 9/1976 | Crow | 60/248 |
| 4,050,240 | 9/1977 | Vaught | 60/39.23 |
| 4,162,611 | 7/1979 | Caruel et al. | 60/748 |

FOREIGN PATENT DOCUMENTS

| | | |
|---|---|---|
| 386159 | 1/1923 | Fed. Rep. of Germany . |
| 950363 | 9/1949 | France . |
| 2357738 | 7/1976 | France . |
| 2341099 | 2/1977 | France . |
| 2391359 | 5/1977 | France . |
| 2491139 | 10/1981 | France . |
| 2491140 | 10/1981 | France . |
| 2085147 | 4/1962 | United Kingdom . |

*Primary Examiner*—Louis J. Casaregola
*Attorney, Agent, or Firm*—Bacon and Thomas

[57] ABSTRACT

A fuel and air injection system for a turbojet engine is disclosed wherein a bowl-shaped member surrounding the fuel injection nozzle defines an impact cooling chamber divided into four sectors. A pair of diametrically opposite sectors have openings to permit air to pass through the cooling chamber into the combustion chamber, while opposite diametrically opposed sectors have openings of larger diameter which also allow communication between the cooling chamber and the combustion chamber. A diaphragm control system allows the air passing into the sectors having the larger diameter openings to be modulated depending upon the throttle setting of the turbojet engine.

9 Claims, 5 Drawing Figures

FUEL AND AIR INJECTION SYSTEM FOR A TURBOJET ENGINE

BACKGROUND OF THE INVENTION

The present invention relates to a primary air and fuel supply system for a combustion chamber, in particular a combustion chamber for a turbojet engine.

Conventional turbojet combustion chambers comprise a primary zone, having a high fuel/air ratio, and a dilution zone, located downstream of the primary zone in which the fuel/air mixute is diluted by mixing it with additional air. The primary air flow passes into the primary zone through external and internal swirl vanes located around the fuel injector so as to create a cone of atomized fuel leaving the injector. The remaining primary air enters the combustion chambers through orifices or openings in the upstream end of the chamber, and through openings in the inner and outer walls of the combustion chamber. The amount of air passing into the primary zone as a percentage of the total air flow from a compressor in most instances is a trade off between the optimum performance level requested of the combustion chamber at full power and the optimum performance requested at idle speed. The performance characteristics at full power require minimum smoke emission and an even temperature distribution throughout the chamber, while the performance requirements at idle are somewhat different so as to promote an efficient, stable idle characteristic.

In view of the higher performance levels required of the combustion chambers in modern turbojet engines, the trade offs between the idle requirements and the full power requirements have become increasingly difficult to achieve. One attempt at resolving this problem has been to design the combustion chamber with two modules; one module designed for full power applications; the other being designed for idling conditions. However, these chambers, in addition to being bulky and costly since they require double the injection points, have also encountered problems in achieving optimum performance in the intermediate power levels between idle and full power.

Another solution which has been incorporated into both the single and the two-module combustion chambers, comprises movable shutters which act as diaphragms to continuously match the air flow distribution of the combustion chamber air intakes to the desired power head such that the operation of the chamber can be continuously optimized. Typical examples of such movable control diaphragms are disclosed in French Pats. Nos. 2,491,139 and 2,491,140. These devices have the disadvantages of poorly guiding the air at the intake of the swirl vanes and also generate large wakes within the combustion chamber.

Aerodynamic, bowl-type injectors have been developed, such as described in U.S. Pat. No. 4,162,611 to Caruel et al. The injector is mounted in the upstream end of the combustion chamber and is surrounded by a bowl-shaped member having a frusto-conical portion flaring outwardly in the downstream direction, and having an end wall perforated by several small-holes through which highly pressurized air enters the atomized fuel cone. Because of the turbulence created by the bowl and the resultant thorough mixing of the atomized fuel, a mini-primary zone is created during idle which promotes the optimum operating characteristics of the combustion chamber.

To improve the intermediate bowl-shaped aerodynamic injectors, the outer swirl vanes, as well as the air intake for the bowl orifices have been equipped with a control diaphragm to modulate the air flow to match the air-fuel mixture proportions at the bowl outlet for all operational modes of the combustion chamber and to match this fuel richness to all intermediary states between idle and full power. Such a design is shown in U.S. patent application Ser. No. 792,685 entitled "Variable Flow Air-Fuel Device for a Turbojet Engine" filed on Oct. 29, 1985.

SUMMARY OF THE INVENTION

An object of the present invention is to improve the design of the intermediate bowl-shaped aerodynamic injectors such that they improve the cooling of the combustion chamber walls and, at the same time, improve the operational efficiency of the combustion chamber at idling conditions. The improved bowl-shaped members may be utilized around each of the fuel injection devices disposed in an annular array adjacent the upstream end of an annular combustion chamber so as to utilize the localized recirculation zones between the adjacent injectors to improve the operating efficiency of the chamber.

The invention provides a system for injecting air and fuel into a combustion chamber of a turbojet engine having at least one fuel injector, at least one external swirl vane passing the atomizing air, and a control diaphragm for modulating the air intake flow for the external swirl vane. A bowl-shaped member is disposed about the fuel injector, and defines an impact cooling chamber and a downstream flange which flares radially outwardly in the downstream direction. The downstream flange is provided with a plurality of openings to inject air in to the atomized cone of fuel. The cooling chamber is divided into four circumferential sectors by radially extending partitions such that diametrically opposite sectors have openings of equal dimensions. A first pair of sectors each have a first plurality of openings with a diameter smaller than the second plurality of openings located in adjacent sectors.

The diameter of the first plurality of holes is computed to provide optimal operation of the combustion chamber during idling, while the diameter of the second plurality of holes is computed to provide optimal efficiency at full power.

According to another feature of the invention, a control diaphragm means is provided to modulate the amount of air passing through the larger diameter, second plurality of holes.

When the fuel and air injection system is applied to an annular combustion chamber having a plurality of injectors arranged in an annular array adjacent an upstream end of the chamber, the bowl-shaped members are oriented such that the first, smaller diameter openings of each bowl-shaped member are adjacent corresponding first plurality of openings of an adjacent bowl-shaped member. The second, larger diameter plurality of holes are located adjacent the inner and outer walls defining the annular combustion chamber so as to improve the cooling of these walls at full power.

DETAILED DESCRIPTION OF THE PREFERRED EMBODIMENTS

Figure 1:
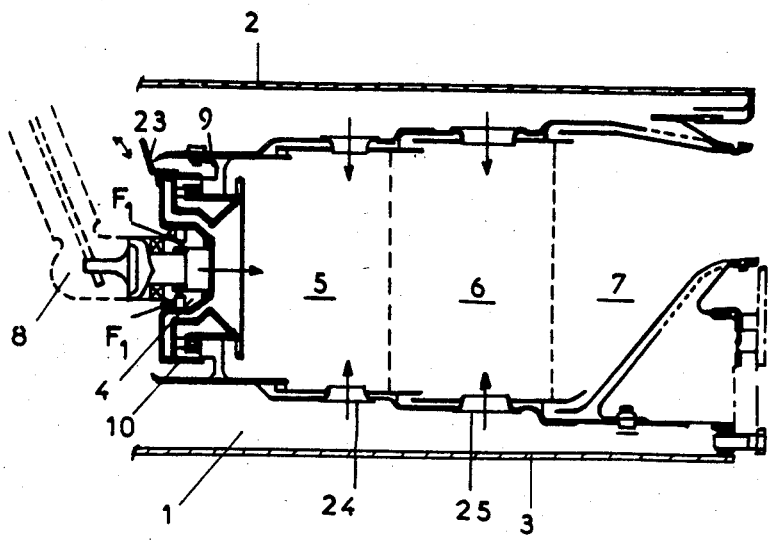
FIG. 1 is a partial, longitudinal sectional view of a combustion chamber having a fuel and air injection system according to the invention.

FIG. 1 is a longitudinal, partial sectional view of a combustion chamber 1 located between an outer casing 2 and an inner casing 3 which define the radial limits for a compressed gas stream emanating from an upstream compressor (not shown). The compressor is typically located to the left of the chamber as shown in FIG. 1, and the compressed gas stream passes from left to right as viewed in FIG. 1. A fraction $F_1$ of the total airstream passes through injection system 4 to form a vaporized fuel mixture with the fuel emanating from fuel injector 8. The vaporized fuel mixture passes into primary zone 5 where the combustion reaction takes place. The resultant gases are diluted in dilution zone 6 and cooled in the secondary downstream zone 7 before passing to a turbine (not shown).

Figure 2:
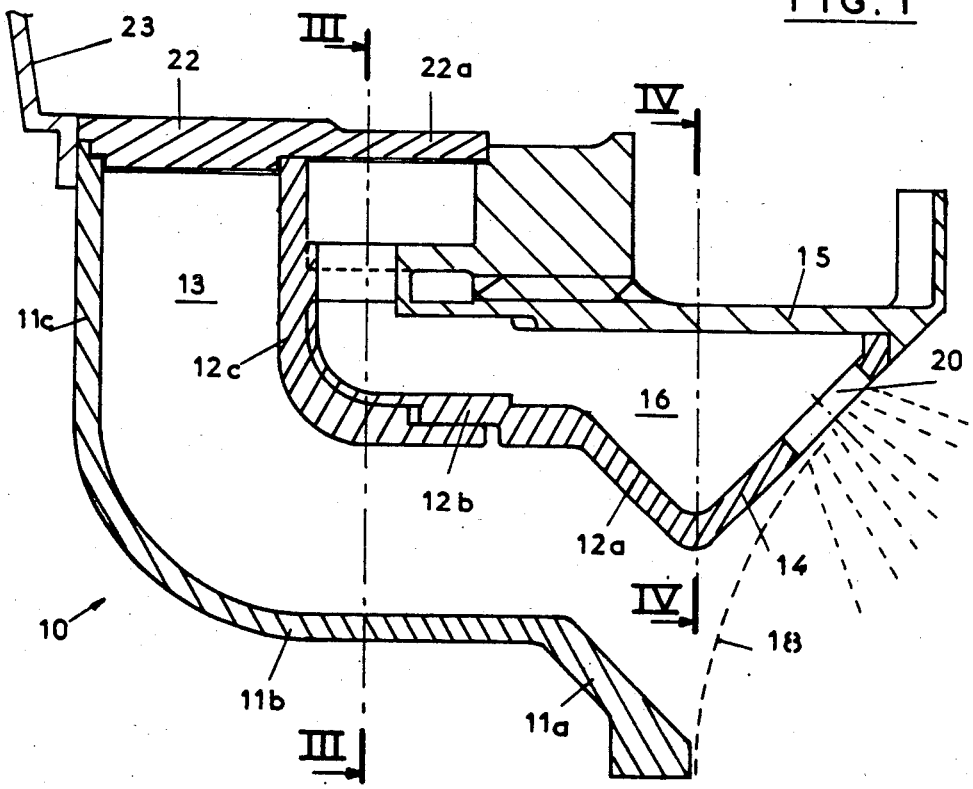
FIG. 2 is a partial, longitudinal sectional view of the bowl-shaped members according to the invention.

The fuel injector 8 is connected to an upstream end 9 of the combustion chamber by intermediate bowl-shaped member 10. In a known manner, the injection system includes inner swirl vane which may be of either the radial or the centripetal-axial type to project the fuel issuing from the injector into a frusto-conical jet expanding radially into a downstream direction. The injector 8 along with its inner swirl vane is enclosed by a cover 11 which forms the upstream wall portion of the intermediate bowl-shaped member 10. The cover 11 includes a frusto-conical part **11*a* which expands radially outwardly in an upstream direction and is joined to a cylindrical support surface 11*b*. Support surface 11*b* is joined to a radial wall 11*c*, as shown in FIG. 2. Radial wall 11*c* together with radial wall 12*c* of intermediary ring 12 define a radial channel 13 having inclined vanes so as to form an external swirl vane for the injection system. The intermediary ring 12 also includes a cylindrical portion 12*b* and frusto-conical support portion 12*a*. The cover 11 and the ring 12** together form an annular axial-centripetal channel for the air from the external swirl vane.

Figure 3:
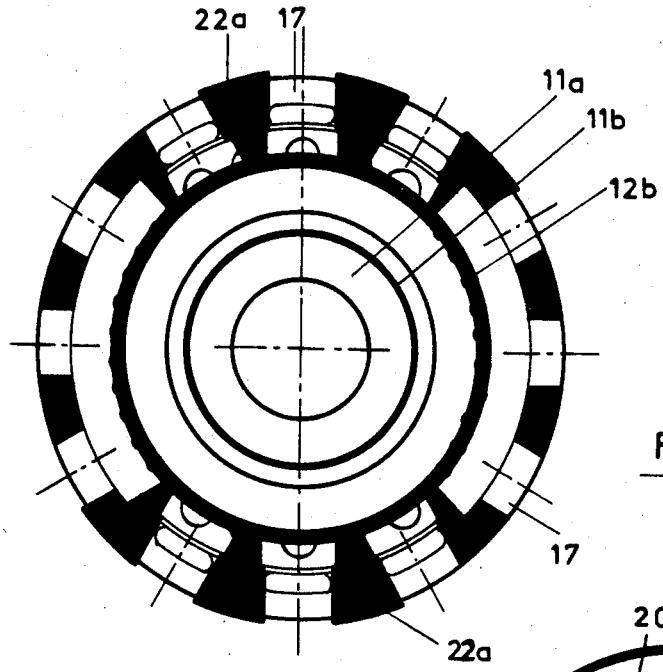
FIG. 3 is a cross-sectional view of the bowl-shaped member according to the invention taken along line III—III in FIG. 2.
Figure 4:
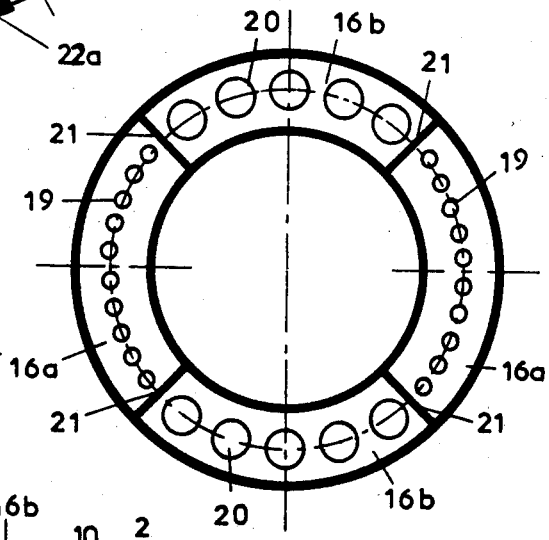
FIG. 4 is a cross-section of the bowl-shaped member according to the invention taken along line IV—IV of FIG. 2.

In a known manner, the air passing into radial channel 13 through the external swirl vanes can be modulated by a diaphragm control device comprising a cylindrical sleeve having air intake orifices equal in number to the air passages in the radial channel 13. As indicated in FIGS. 2 and 3, the diaphragm control means 22 is rotatably attached about the intermediate bowl-shaped member 10 and its rotation may be controlled in known fashion through an actuating lever 23 attached thereto. By rotating the diaphragm 22 with respect to the remaining structure, it is possible to place the openings in the diaphragm 22 in alignment with the passage 13 to allow the maximum flow of air, or to place the diaphragm 22 in a position where the openings are out of alignment with the radial channel so as to minimize or eliminate completely the air flow through this channel. It is thereby possible to completely block off radial channel 13 during the operation of the engine at idle speed and to continuously open the passage to a full open position to efficiently operate the combustion chamber at full power settings. This enables the optimization of the air-fuel parameters (percentages of air and fuel, volume distribution, atomization) during all operational conditions. This is possible since the external vane includes a large axial component during full power operation and a slight axial component during idle. Also, since the bowl throat cross-section is constant, the flow rate (which is axial at that point) is directly proportional to the flow of air during the increase from idle to full power.

The intermediate ring 12 also has a frusto-conical flange 14 which flares radially outwardly in a downstream direction. An outer skirt 15 is attached to the downstream edge of flange 14 and is attached to the upstream end 9 combustion chamber by known attachment means, as shown in FIG. 1. The intermediate ring 12, the downstream flange 14 and the outer skirt 15 of the bowl-shaped member 10 define an annular impact cooling chamber 16. Import cooling chamber 16 communicates with the pressurized air stream through radial apertures 17 which are regularly distributed about its periphery.

According to the invention, the cooling chamber 16 is divided into four equal and diametrically opposite sectors **16*a* and 16*b* by radially extending partitions 21. Although the invention will be described as having four such sectors, it is to be understood that a greater or lesser number of sectors could be utilized without exceeding the scope of this invention. The downstream flange 14 defines a plurality of openings regularly distributed about its periphery such that air emitted into the sectors 16*a* and 16*b* may exhaust from the chamber so as to atomize the conical fuel/air mixture 18 formed between the air jets issuing from the external and internal swirl vanes. The openings defined by downstream flange 14 comprise a first plurality of openings 19 located in a first pair of diametrically opposite sectors 16*a* having a first diameter, and a second plurality of openings 20 located in second sectors 16*b*** having a second diameter wherein the second diameters are larger than the first diameters.

The first sector **16*a* and the second sector 16*b* are separately supplied with pressurized air through radial apertures 17, the partitions 21 serving to completely insulate the sectors from each other. Apertures 17 supplying the second sectors 16*b* having the larger diameter openings 20 may be controlled by diaphragm control means 22*a* so as to modulate the flow of air into these sectors and, consequently, to modulate the flow of air exhausting through larger diameter openings 20. Diaphragm control means 22*a* may be rigidly attached to diaphragm control ring 22 so as to simultaneously modulate the air passing into radial passage 13 and radial apertures 17**.

When the diaphragms 22 and **22*a* are simultaneously moved to their closed positions the larger diameter openings 20 in sectors 16*b* will not be supplied with air. However, the smaller diameter openings 19 of sectors 16*a* are continuously supplied with compressed air and serve to exhaust such air into the combustion chamber to promote an efficient and stable operating conditions during idling. As the engine's power level is moved from idle toward full power, the diaphragms 22 and 22***a* are gradually opened so as to allow air to pass into the sectors 16*b* and exhaust through larger diameter openings 20. This serves to maximize the operating parameters at intermediate and full power throttle openings.

Figure 5:
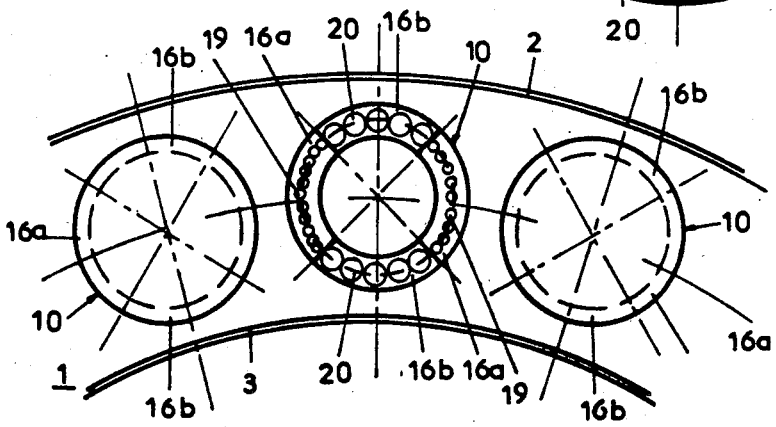
FIG. 5 is a partial, sectional view showing an annular combustion chamber incorporating the bowl-shaped member according to the invention.

FIG. 5 shows the orientation of the intermediate bowl-shaped members according to the invention when utilized in conjunction with an annular combustion chamber having a plurality of fuel injectors arranged in an annular array about its upstream end. As can be seen, the bowl-shaped members 10 are oriented such that the sectors 16*a*, having the first plurality of smaller diameter openings 19, are located adjacent corresponding sectors of adjacent bowl-shaped members. The second sectors 16*b* having the larger diameter openings 20, are located adjacent outer casing 2 and inner casing 3, respectively such that the air emanating from these openings provides maximum cooling to the internal surfaces of these walls at full power.

Aside from providing the adequate cooling under full power conditions, this orientation of the bowl-shaped members causes a recirculation zone localized between adjacent injectors, where the flame is localized just before extinction. Thus, by maintaining a constant supply of air and fuel in this recirculation zone through openings 19, the flame stability under idling conditions is markedly improved. Separating the bowl-shaped member into independent sectors, each independently supplied with air, allows achieving this result. The diameter of the smaller openings 19 formed in sectors 16*a* may be computed such that the idle efficiency of the injection system is at an optimum when the diaphragms 22 and 22*a* are in their closed positions.

The size of the larger openings 20 located in sectors 16*b* may be computed so as to optimize the operation of the combustion chamber at full power when the diaphragms 22 and 22*a* are in their fully open position. It has been found, for an experimental bowl-shaped member, that the optimum efficiency at idle and full power sittings was achieved by forming ten openings 19 in each of the first sectors 16*a* with each opening having a diameter of 2 mm; and by forming five openings 20 in sectors 16*b*, each opening having a diameter of 4 mm.

Another computational parameter in determining the number and size of the openings of each sector is the percentage of air emitted into the combustion chamber by the external and internal swirl vanes, by the bowl, and by the other air intake orifices of the combustion chamber (primary orifices 24, dilution orifices 25, and impact wall cooling means such as peripheral or convection wall cooling means). The dimensions and the number of openings 19 and 20 are such that the air intake rate from the injection system into the combustion chamber (internal swirl vane plus external swirl vane plus bowl-shaped member openings) varies from 5% to 22% of the total air intake of the combustion chamber. The particular flow rates relative to the total air flow rate of the combustion chamber may vary between idle and full power settings as follows:

from 1% to 13% for the external swirl vanes;

from 0 to 4% for the bowl-shaped member openings 20 of the second sectors.

The flow rates of the internal swirl vanes and the bowl-shaped member openings 19 in the first sectors remain constant at approximately 3% and 2%, respectively, of the total air intake of the combustion chamber across the entire operational range of the turbojet engine.

The design of the individual bowl-shaped members along with the mutual orientation of the adjacent members coupled with the variation of the swirl angle of the external swirl vane derived from the upstream location of diaphragm 22 allows varying the volumetric distribution of the air-fuel mixture between idle and full power in the reaction zone and thereby improves the flame stability and allows a continuous modulation of these parameters across the entire operational range of the combustion chamber.

The foregoing description is provided for illustrative purposes only and should not be construed as any way limiting this invention, the scope of which is defined solely by the appended claims.

What is claimed is:

1. In a turbojet engine having a combustion chamber, at least one fuel injector to inject fuel into an upstream end of the combustion chamber, at least one external swirl vane passing air into the combustion chamber to create a turbulent fuel/air mixture, and a first diaphragm control means to modulate the intake air of the external swirl vane, the improved fuel and air injection system comprising:

(a) a bowl shaped member mounted adjacent to an upstream end of the combustion chamber, the bowl shaped member defining air inlet means, and an impact cooling chamber communicating with the air inlet means and having a downstream wall flaring radially outwardly in the downstream direction;

(b) a plurality of generally radially extending partitions extending through the cooling chamber and dividing the chamber into a plurality of pairs of sectors, each sector of the pair being located diametrically opposite the other sector of the pair;

(c) a first plurality of openings defined by the downstream wall and located in a first pair of sectors so as to communicate with the cooling chamber and the combustion chamber; and, (d) a second plurality of openings defined by the downstream wall and located in a second pair of sectors so as to communicate with the cooling chamber and the combustion chamber, wherein the sizes of the second plurality of openings are greater than the sizes of the first plurality of openings.

2. The improved fuel and air injection system according to claim 1 wherein the first plurality of openings allow passage of air from the cooling chamber into the combustion chamber so as to operate the turbojet engine at idle power under optimum efficiency and wherein the second plurality of openings allow passage of additional air from the cooling chamber to the combustion chamber so as to operate the turbojet engine at full power under optimum efficiency.

3. The improved fuel and air injection system according to claim 1 further comprising a second diaphragm control means associated with the bowl shaped member so as to modulate the flow of air through the second plurality of openings;

4. The improved fuel and air injection system according to claim 3 further comprising means interconnecting the first and second diaphragm control means such that they are operated simultaneously.

5. The improved fuel and air injection system according to claim 1 further comprising:

(a) concentrically arranged inner and outer walls defining a generally annular combustion chamber therebetween; and, (b) a plurality of bowl shaped members, disposed in an annular array adjacent to an upstream end of the combustion chamber such that the first plurality of openings of one bowl shaped member is located adjacent to the first plurality of openings of an adjacent bowl shaped member.

6. The improved fuel and air injection system according to claim 5 wherein the sizes of the first plurality of openings are such that they allow passage of approximately 2% of the total air flow into the combustion chamber.

7. The improved fuel and air injection system according to claim 6 wherein the sizes of the second plurality of openings are such that they allow a maximum passage of approximately 4% of the total air flow into the combustion chamber.

8. The improved fuel and air injection system according to claim 5 further comprising second diaphragm control means associated with each bowl shaped member so as to modulate the flow of air through the second plurality of openings of each bowl shaped member.

9. The improved fuel and air injection system according to claim 8 further comprising means interconnecting the first and second diaphragm control means such that they are operated simultaneously.

* * * * *

UNITED STATES PATENT AND TRADEMARK OFFICE

CERTIFICATE OF CORRECTION

PATENT NO. : 4,696,157

DATED : Sep. 29, 1987

INVENTOR(S) : BARBIER et al

It is certified that error appears in the above—identified patent and that said Letters Patent is hereby corrected as shown below:

Col. 1, line 13, "mixute" should be --mixture--.

Col. 5, line 42, "sittings" should be --settings--.

Col. 6, line 62, the ";" should be a --.--.

Signed and Sealed this

Twenty-fourth Day of May, 1988

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,696,157

DATED : September 29, 1987

INVENTOR(S) : BARBIER ET AL

It is certified that error appears in the above—identified patent and that said Letters Patent is hereby corrected as shown below: On the title page Inventor's name should be --GERALD J. P. BAYLE-LABOURE-- not "GERALD J. P. B. LEBOURE"

Signed and Sealed this

Twenty-fifth Day of October, 1988

*Attest:*

DONALD J. QUIGG

*Attesting Officer*

*Commissioner of Patents and Trademarks*